US007287733B2

(12) United States Patent
Bongio et al.

(10) Patent No.: US 7,287,733 B2
(45) Date of Patent: Oct. 30, 2007

(54) CEILING SUSPENSION STRUCTURE

(75) Inventors: Vincent J. Bongio, Syracuse, NY (US); Thomas E. Cavallo, Liverpool, NY (US)

(73) Assignee: Sullivan, Bazinet, Bongio, Inc., Syracuse, NY (US)

( * ) Notice: Subject to any disclaimer, the term of this patent is extended or adjusted under 35 U.S.C. 154(b) by 766 days.

(21) Appl. No.: 10/146,386

(22) Filed: May 14, 2002

(65) Prior Publication Data

US 2003/0213199 A1 Nov. 20, 2003

(51) Int. Cl.
*E04B 9/18* (2006.01)

(52) U.S. Cl. ..... 248/235; 52/506.08

(58) Field of Classification Search ..... 52/506.01, 52/506.07, 506.08, 711, 708, 710; 248/220.1, 248/235; 411/85, 84, 104
See application file for complete search history.

(56) References Cited

U.S. PATENT DOCUMENTS 2,345,650 A * 6/1944 Attwood ..... 189/36
2,676,680 A * 4/1954 Kindorf ..... 189/35
3,174,590 A * 3/1965 Haker ..... 189/34
3,205,927 A * 9/1965 Phelan ..... 411/104
3,483,910 A * 12/1969 La Londe et al. ..... 151/41.75
4,146,074 A * 3/1979 Kowalski ..... 151/41.75
4,163,350 A * 8/1979 Doguchi et al. ..... 52/403
4,575,295 A 3/1986 Rebentisch ..... 411/85
4,948,313 A * 8/1990 Zankovich ..... 411/85
4,967,530 A * 11/1990 Clunn ..... 52/506.08
5,359,826 A 11/1994 Grearson ..... 52/650.1
5,988,930 A 11/1999 Liebetrau et al. ..... 403/292
6,070,383 A * 6/2000 Jeanseau ..... 52/506.05
6,317,915 B1 * 11/2001 Grearson ..... 14/73
6,513,295 B2 * 2/2003 Bernardino ..... 52/506.09

* cited by examiner

*Primary Examiner*—Carl D. Friedman
*Assistant Examiner*—Steven Marsh
(74) *Attorney, Agent, or Firm*—August E. Roehrig, Jr.; Luedeka, Neely & Graham, P.C.

(57) ABSTRACT

A threaded coupling member for supporting a suspended ceiling grid system from an overhead support structure. A threaded connector nut is designed to be placed or dropped into an upper channel of the suspended ceiling grid system whereby, because of the configuration of the connector nut, a threaded opening formed through the connector nut will be positioned for engagement by a threaded end of the coupling member.

9 Claims, 3 Drawing Sheets

22
25
20
26
40
12
10
15
15
14
14
12
12
11
11a
11
11a
11
W
26
16
16
17
17
30
D
W
18

CEILING SUSPENSION STRUCTURE

TECHNICAL FIELD

This invention relates in general to suspended ceiling supports and, in particular, to a support to be used for suspending ceilings from an overhead roof or support structure for use with channeled components of a suspended ceiling grid.

BACKGROUND TECHNOLOGY

Suspended ceilings are frequently formed utilizing a channelled grid or frame work which is engaged by a suitable fastener to suspend the ceiling grid from an existing roof or overhead support structure. In this manner the suspended grid-work is used to form a suspended ceiling at a height above the floor. The space so formed above the ceiling can be used for various purposes such as the support of mechanical services such as heating, ventilating and air conditioning systems (HVAC) or to form an upper seal for the space below the ceiling to preserve the integrity of a particular enclosed area such as used in cleanrooms.

These suspended ceiling grids are used in combination with panels which are fitted into the grid-work for forming the suspended ceiling. To this end, various configurations of grid-works are utilized, and in certain applications the uppermost portion of the grid-work is formed with a longitudinally extending runner and/or cross member having a substantially U-shaped cross-section to form a channel by which the grid system is connected to a support structure for suspending the ceiling from the overhead support.

There are many variations of fasteners utilized to secure such suspension structures to a channeled suspended ceiling grid system. Such systems, however, are frequently difficult or inconvenient to install, while others are designed for use with a specific type of ceiling grid system.

Accordingly, the present invention is directed to overcoming one or more of the problems or disadvantages associated with the relevant technology.

SUMMARY OF THE INVENTION

In accordance with the present invention, there is provided a threaded connector nut for engagement by a threaded coupling member for supporting a suspended ceiling grid system from an overhead support structure. The threaded connector nut is designed to be placed or dropped into an upper channel of the suspended ceiling grid system whereby, because of the configuration of the connector nut, a threaded opening formed through the connector nut will be positioned for engagement by a threaded end of the coupling member. The configuration of the connector nut facilitates ease of installation, and permits the connector nut to be located along the longitudinally extending channel to facilitate alignment with the overhead support structure.

BRIEF DESCRIPTION OF THE DRAWINGS

In the accompanying drawings, like reference numerals indicate corresponding parts throughout, wherein.

BEST MODE FOR CARRYING OUT THE INVENTION

Figure 1:
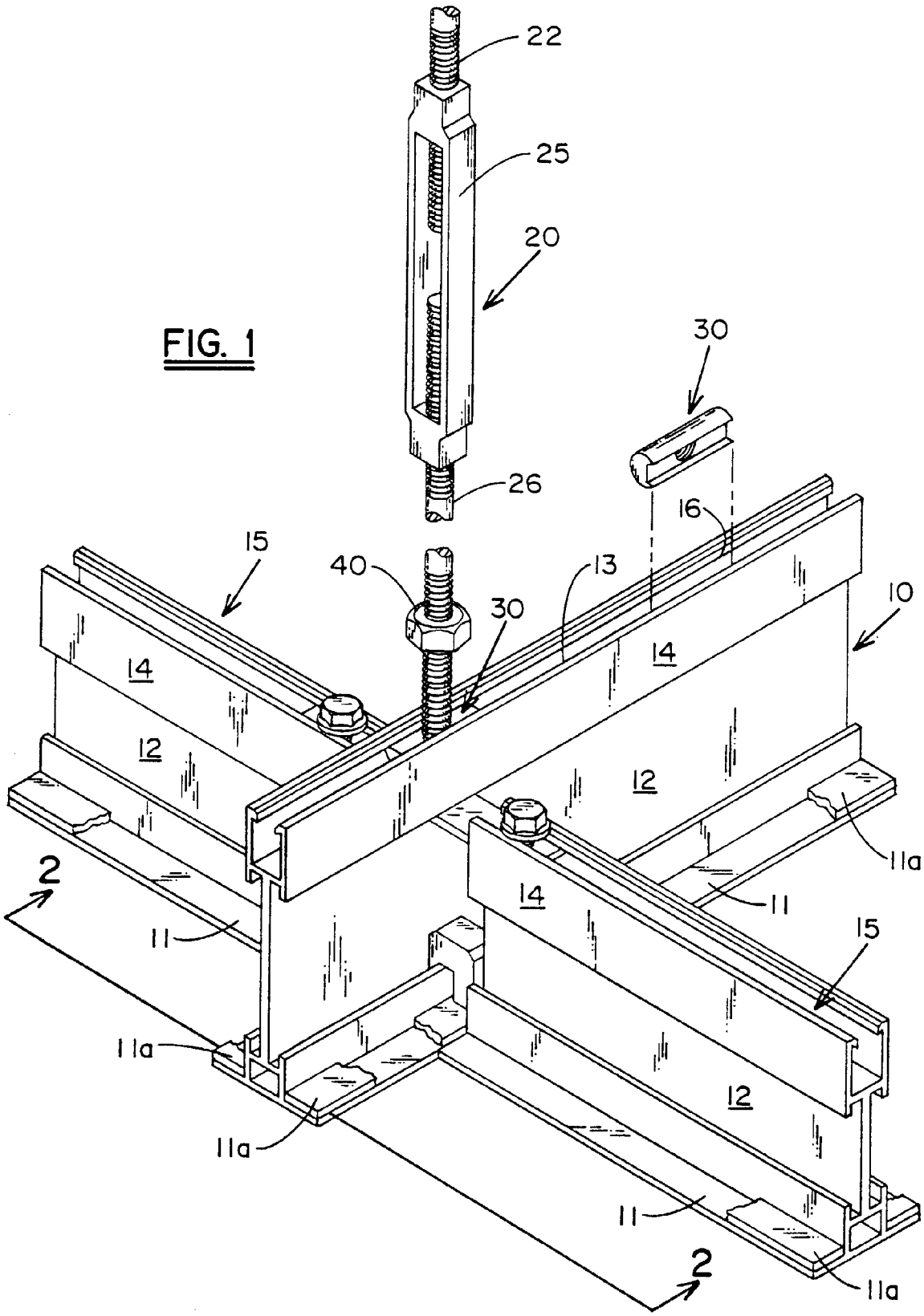
FIG. 1 is a perspective view of one embodiment of the present invention installed on a portion of a suspended ceiling grid-work.
Figures 2, 3:
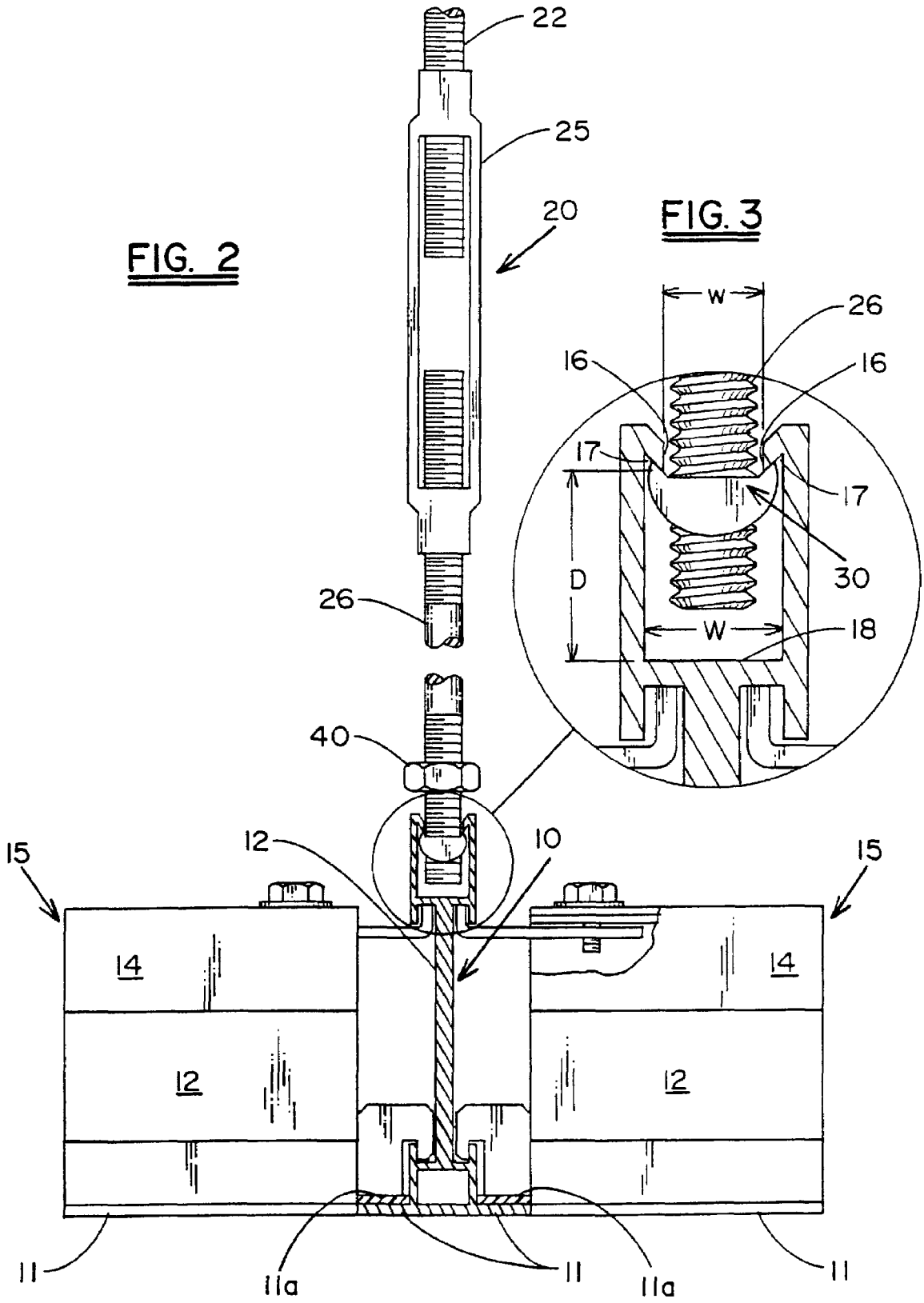
FIG. 2 is a planar cross-sectional view of a runner and associated cross-pieces utilized in a suspended ceiling grid-work taken in the direction of lines 2-2 of FIG. 1.
FIG. 3. is an enlarged view of a portion of the invention incorporated in the suspended ceiling grid-work illustrated in FIG. 2.
Figure 6:
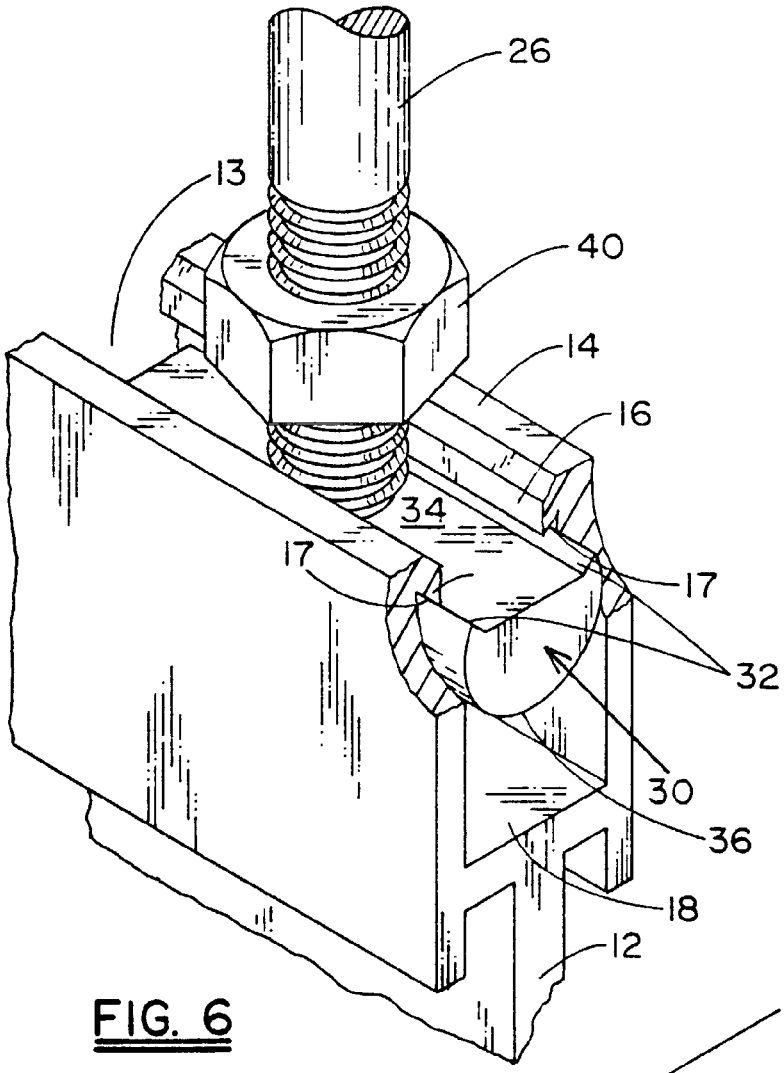
FIG. 6 is an enlarged perspective view of the connector nut threadingly attached to a suspension rod and engaging the channel of a runner for a suspended ceiling grid-work.
Figure 5:
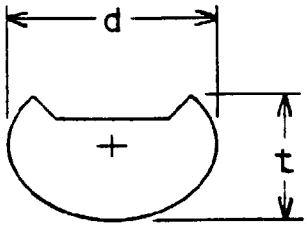
FIG. 5 is front planar view of the connector nut illustrated in FIG. 4.
Figure 4:
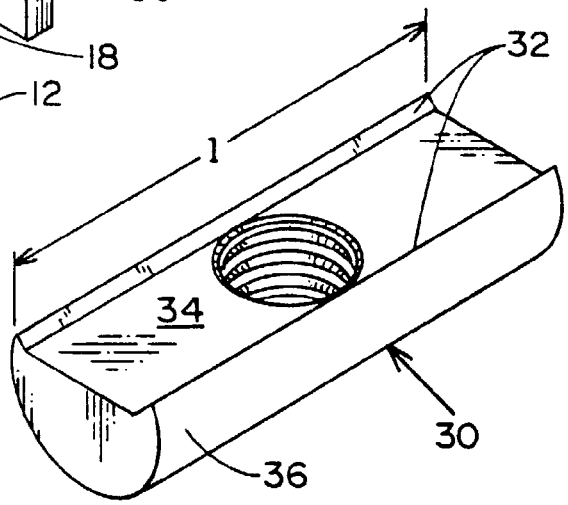
FIG. 4 is an enlarged perspective view of a connector nut which is utilized to retain the grid-work runner to the suspended ceiling support.

Referring now to the drawings, there is illustrated in FIGS. 1 and 2, a portion of a grid-work of a suspended ceiling system. Such a grid-work typically includes a runner 10, and connecting cross-members 15, which are secured to and held in suspension by their connection with the runners 10. Both the runners 10 and the cross-members 15 typically include an outwardly extending flange 11, at the lower portion of each of the cross-members and runners, for supporting a ceiling panel (not shown). To form a sealed overhead structure, a seal 11*a* may be included on the upper surface of the flange 11.

The runner 10 and cross-members 15 typically include a vertically extending chord 12 which extends upwardly from the flanged end and has at the upper portion thereof an open channel 14. The channel 14 of the cross-members is generally used for securing the cross-members 15 in a position substantially normal or perpendicular to the chord 12 of the runner 10. The open channel 14 formed on the runner 10 extends the longitudinal length thereof and is used to connect the runner 10 to a coupling portion 20 of a suspension member 22 which is typically secured to the roof, ceiling or an overhead support structure from which a suspended ceiling is to be suspended.

Such a suspension member 22 can include a rod or cable which is connected to the runner 10 through a suitable connector for suspending the ceiling grid-work. A turnbuckle 25 is frequently used for adjusting the vertical positioning of the runner 10. A threaded adjusting rod or member 26 is adjustably threadingly connected at one end to the turnbuckle 25, and at the distal end to a connector nut 30 carried in the open channel 14 of the runner 10 to secure and suspend the ceiling grid at the desired height above the floor.

Referring in particular to FIGS. 3-6, there is illustrated a coupling structure for hanging the grid-work of a suspended ceiling from spaced overhead supports. The coupling includes the threaded connector nut 30 having a thread formed therethrough for engagement with a mating thread of the adjusting rod 26 from which the grid-work is to be suspended. The connector nut 30 is formed of a length "l", preferably exceeding its greatest width "d" to facilitate proper positioning of the connector nut 30 within the confines of the open channel 14 formed on the upper portion of the grid runners 10.

The connector nut 30 has a substantially "D" shaped cross-section, and includes a pair of sloped ramped portions 32 extending outwardly from a flat planar surface 34 to the concave shaped outer surface 36 throughout the length "l" of the connector nut 30. The remaining outer surface 36 of the connector nut 30 is substantially cylindrical in form, or in other words in accordance with another accepted description, has a surface in the shape of a cylinder, and has a diameter "d" which defines the maximum dimension or width of the connector nut 30. The maximum thickness "t" of the connector nut 30 is the perpendicular distance from a plane across the tips of the ramp portions 32 to the outer edge of the circumferential surface 36. Such a configuration of the connector nut 30 results in the connector nut assuming a stable position whenever inserted into the channel 14 through the opening 13 in the top thereof. When inserted through the opening 13, the flat horizontal surface 34 of the connector nut 30 will face upwardly and outwardly from the base 18 of the channel 14 to facilitate engagement with the threaded connector 26.

To this end, the width "w" of the opening 13 in the channel 14, or the cross member 15, defined as the maximum space between the vertical faces 16, is at least equal to or larger than the "t" thickness of the connector nut 30, but less than the diameter "d". The interior width "W" and the interior depth "D" of the runner channel 14 is at least equal to or larger than the diameter "d" of the connector nut 30. Each side of the upper portion of channels 14 has an undercut 17 formed in a shape complementary to the sloped ramp portions 32 of the connector nut 30. In this manner, when the connector nut 30 is engaged with and tightened to the threaded adjusting rod 26 of the turnbuckle 25, the connector nut 30 will be secured to the runner 10.

FUNCTIONAL DESCRIPTION

When the instant ceiling suspension is utilized, the connector nut 30 may be installed into a ceiling runner 10 at any position along the longitudinal length of the runner. The connector nut 30 can be inserted into the channel 14 of the runner 10 simply by dropping the connector nut 30 through the opening 13 on the top of the channel 14. Because the width "w" of the opening 13 is at least equal to the thickness "t" of the connector nut 30, but less than the diameter "d", the connector nut 30 can only fit through the opening 13 when the connector nut 30 is positioned with the planar surface 34 facing one of the vertical faces 16 of the channel 14. In this manner, the connector nut 30 will drop through the opening 13 in the channel 14 of the runner 10 in such an orientation.

When the connector nut 30 drops through the opening 13 in that orientation, the connector nut 30 will come to rest on the bottom 18 of the channel 14 with the planar surface 34 facing upwardly towards the opening 13 through which the connector nut 30 was inserted. Accordingly, the connector nut 30 will always be positioned properly to receive the threaded adjusting rod 26 by which the runner 10 will be suspended from an overhead support structure. The tightening of a nut 40, and associated bearing and lock washers (not shown), carried by the threaded rod 26, will cause the sloped ramped portions 32 of connector nut 30 to engage the undercuts 17 of the channel 14, thereby securing runner 10 to the overhead support structure.

Other aspects and features of the present invention can be obtained from a study of the drawings, the disclosure, and the appended claims.

The invention claimed is:

1. A suspended ceiling coupling for positioning a suspended ceiling grid-work from an overhead support structure, comprising:

a suspended ceiling grid-work member having an open channel portion including an opening in a top portion thereof for receiving a connector nut for use in suspending said grid-work member from an overhead support structure;

a connector nut having a substantially "D"-shaped cross section and positionable in said open channel of said grid-work member by passage through said opening in the top portion of said open channel portion of said grid-work member;

said opening in said top portion of said open channel being at least as wide as a first cross-sectional dimension of said connector nut, but less than a second cross-sectional dimension of said connector nut; and said open channel portion having a width and a depth at least as great as said second cross-sectional dimension of said connector nut.

2. The suspended ceiling coupling according to claim 1 wherein said suspended ceiling grid-work includes a flange portion for supporting a ceiling panel.

3. The suspended ceiling coupling according to claim 2 wherein said flange portion includes a seal for sealing a ceiling panel to said suspended ceiling grid-work.

4. The suspended ceiling coupling according to claim 1 wherein a portion of said connector nut has an outer surface in the shape of a cylinder for engaging a base portion of said open channel.

5. The suspended ceiling coupling according to claim 4 wherein a portion of said connector nut has a flat planar outer surface.

6. The suspended ceiling coupling according to claim 5 wherein said flat planar outer surface of said connector nut faces said opening in said top portion of said open channel when said outer surface in the shape of a cylinder of said connector nut engages said base portion of said open channel.

7. The suspended ceiling coupling according to claim 5 further including a threaded opening extending through said connector nut between said flat planar outer surface and said outer surface in the shape of a cylinder.

8. The suspended ceiling coupling according to claim 5 wherein said connector nut further includes at least one sloped ramp portion extending between said connector nut flat planar outer surface and said outer surface in the shape of a cylinder.

9. The suspended ceiling coupling according to claim 8 wherein at least one edge of said opening in a top portion of said open channel is formed with an undercut having a configuration complementary to said sloped ramp portion of said connector nut for engagement therewith.

* * * * *